US010233913B2

(12) United States Patent
Mori et al.

(10) Patent No.: US 10,233,913 B2
(45) Date of Patent: Mar. 19, 2019

(54) LIQUID SUPPLY SYSTEM

(71) Applicant: Eagle Industry Co., Ltd., Tokyo (JP)

(72) Inventors: Koichi Mori, Tokyo (JP); Yoshio Osawa, Tokyo (JP); Kiyotaka Furuta, Tokyo (JP)

(73) Assignee: EAGLE INDUSTRY CO., LTD., Tokyo (JP)

( * ) Notice: Subject to any disclaimer, the term of this patent is extended or adjusted under 35 U.S.C. 154(b) by 67 days.

(21) Appl. No.: 15/323,589

(22) PCT Filed: Jul. 9, 2015

(86) PCT No.: PCT/JP2015/069741
§ 371 (c)(1),
(2) Date: Jan. 3, 2017

(87) PCT Pub. No.: WO2016/006648
PCT Pub. Date: Jan. 14, 2016

(65) Prior Publication Data

US 2017/0167475 A1 Jun. 15, 2017

(30) Foreign Application Priority Data

Jul. 10, 2014 (JP) ..... 2014-142553

(51) Int. Cl.
*F04B 15/08* (2006.01)
*F04B 43/08* (2006.01)
(Continued)

(52) U.S. Cl.
CPC ..... *F04B 15/08* (2013.01); *F04B 43/08* (2013.01); *F04B 43/084* (2013.01);
(Continued)

(58) Field of Classification Search
CPC ..... F04B 43/084–43/088; F04B 45/02–45/04
See application file for complete search history.

(56) References Cited

U.S. PATENT DOCUMENTS 2,464,095 A 3/1949 Nies
6,107,905 A * 8/2000 Itoh ..... F17C 3/085 335/216
(Continued)

FOREIGN PATENT DOCUMENTS

FR 796685 A * 4/1936 ..... F04B 5/02
FR 2666853 A1 * 3/1992 ..... F04B 37/14
(Continued)

OTHER PUBLICATIONS

English translation of WO2015078487A1, provided by Espacenet. May 2018.*
(Continued)

*Primary Examiner* — Tareq Alosh
(74) *Attorney, Agent, or Firm* — Harness, Dickey & Pierce, P.L.C.

(57) ABSTRACT

A liquid supply system includes first and second bellows 41 and 42 arranged in series in an expanding/contracting direction thereof in a vessel 12 and having first end portions respectively, which are close to each other and fixed to an inner wall of the vessel 12, and also having second end portions respectively, which are distant from each other and movable in the expanding/contracting direction. An inner space of the vessel 12 located outside the first bellows 41 serves as a first pump chamber P1. An inner space of the vessel 12 located outside the second bellows 42 serves as a second pump chamber P2. An inner space of the vessel 12 located inside the first and second bellows 41 and 42 serves as a sealed space R1. A shaft 15 to which the respective second end portions of the first and second bellows 41 and 42 are fixed is reciprocally moved to expand/contract the first and second bellows 41 and 42.

11 Claims, 6 Drawing Sheets

(51) Int. Cl.
*F25B 9/00* (2006.01)
*F04B 45/02* (2006.01)

(52) U.S. Cl.
CPC ..... *F04B 43/088* (2013.01); *F04B 45/024* (2013.01); *F25B 9/00* (2013.01); *F04B 2015/081* (2013.01)

(56) References Cited

U.S. PATENT DOCUMENTS

| | | | | |
|---|---|---|---|---|
| 8,096,785 | B2 * | 1/2012 | Eysymontt | F04B 43/1136 417/395 |
| 2005/0191195 | A1 * | 9/2005 | Oniduka | F04B 43/084 417/473 |
| 2006/0165541 | A1 * | 7/2006 | Teshima | F04B 11/0016 417/472 |
| 2014/0054318 | A1 | 2/2014 | Saito et al. | |
| 2015/0276131 | A1 | 10/2015 | Mori et al. | |

FOREIGN PATENT DOCUMENTS

| | | | | |
|---|---|---|---|---|
| JP | S61-246559 | A | 11/1986 | |
| JP | S63-194709 | A | 8/1988 | |
| JP | H10231784 | A | 9/1998 | |
| JP | H11030184 | A | 2/1999 | |
| WO | WO 9004106 | A1 * | 4/1990 | F04B 43/086 |
| WO | WO 2010098176 | A1 * | 9/2010 | A61M 16/0075 |
| WO | 2012/124363 | A1 | 9/2012 | |
| WO | 2014/091866 | A1 | 6/2014 | |
| WO | WO 2015010170 | A1 * | 1/2015 | F04B 43/084 |
| WO | WO 2015078487 | A1 * | 6/2015 | F04B 43/0054 |

OTHER PUBLICATIONS

Extended European Search Report dated Jan. 23, 2018 (corresponding to EP15818721.1).

* cited by examiner

LIQUID SUPPLY SYSTEM

CROSS-REFERENCE TO RELATED APPLICATIONS

This application is a National Stage of International Application No. PCT/JP2015/069741, filed Jul. 9, 2015 (now WO 2016/006648A1) which claims priority to JP2014-142553, filed Jul. 10, 2014. The entire disclosures of each of the above applications are incorporated herein by reference.

FIELD

The present disclosure relates to a liquid supply system which supplies an ultracold liquid such as liquid nitrogen or liquid helium.

BACKGROUND

Conventionally, a technique has been known which supplies an ultracold liquid such as liquid nitrogen to a vacuum insulated pipe containing a superconducting cable or the like to hold the superconducting cable or the like in an ultracold state. A liquid supply (circulation) system for an ultracold liquid constantly supplies an ultracold liquid into a vacuum insulated pipe so as to cause a to-be-cooled device in which a superconducting cable is provided in the vacuum insulated pipe to hold the superconducting cable in a superconductive state.

A conventional superconducting cable has a short length and, as the discharge pressure required by a liquid supply system, a comparatively low discharge pressure relative to a flow rate is sufficient. Accordingly, as a pump mechanism, a centrifugal pump is representatively used in most cases. However, since a future superconducting cable may have a long length of several kilometers and a place where the superconducting cable is laid may have a level difference, the discharge pressure required by a liquid supply system relative to a flow rate is higher than required conventionally. In a liquid supply system using a centrifugal pump mechanism, the discharge pressure of a pump is low. Therefore, to transfer a liquid over a long distance using only the liquid supply system, it is necessary to, e.g., arrange a plurality of pumps along the cable and maintain the discharge pressure, resulting in higher cost. In addition, when the topography of the place where the cable is laid has a level difference, the pump discharge pressure becomes insufficient so that the laying of the cable is limited.

As another liquid supply system, a positive-displacement bellows circulator as shown in each of FIGS. 5(*a*) to 5(*c*) is known (See PTL 1). However, since a conventional positive-displacement bellows circulator has a structure in which an internal pressure is exerted on a bellows, it is comparatively difficult to provide a higher-pressure positive-displacement bellows circulator. In addition, when a high discharge pressure is exerted as an internal pressure on a bellows, the bellows may buckle. Moreover, since a configuration is used in which a vacuum insulated vessel is filled with an ultracold liquid and the positive-displacement bellows circulator is inserted and immersed therein, heat in-leak results from heat transfer via the supporting member of the positive-displacement bellows circulator and also from heat transfer via the wall surface of the vacuum insulated vessel.

CITATION LIST

Patent Literature

SUMMARY

Technical Problem

An object of the present disclosure is to provide a liquid supply system with an improved pumping function.

Solution to Problem

To attain the foregoing object, a liquid supply system in the present disclosure includes: a vessel configured to suck in a liquid from a first path communicating with the outside of a system and transmit the liquid that has been sucked to a second path communicating with the outside of the system; first and second bellows arranged in series in an expanding/contracting direction thereof in the vessel and having first end portions respectively, which are close to each other and fixed to an inner wall of the vessel, and also having second end portions respectively, which are distant from each other and movable in the expanding/contracting direction; and a shaft which is inserted into the vessel and to which the respective second end portions of the first and second bellows are fixed, the shaft being reciprocally moved in the expanding/contracting direction by a drive source to expand/contract the first and second bellows, wherein an inner space of the vessel located outside the first bellows serves as a first pump chamber provided with a first inlet port through which the liquid is sucked from the first path into the first pump chamber and a first outlet port through which the liquid that has been sucked in is transmitted from within the first pump chamber to the second path, an inner space of the vessel located outside the second bellows serves as a second pump chamber provided with a second inlet port through which the liquid is sucked from the first path into the second pump chamber and a second outlet port through which the liquid that has been sucked in is transmitted from within the second pump chamber to the second path, and a sealed space is formed inside each of the first and second bellows.

According to the present disclosure, the reciprocal movement of the shaft integrally moves the respective second end portions of the first and second bellows in the expanding/contracting directions of the bellows. That is, by the movement of the shaft in one direction, one of the first and second bellows is contracted and the other thereof is expanded. The liquid is sucked from the first path into one of the first and second pump chambers, while the liquid is transmitted from the other thereof to the second path. Thus, the reciprocal movement of the shaft allows the liquid to be supplied continuously and alternately from the first and second pump chambers and allows liquid supply with reduced pulsation. In this pumping operation, a pressure acting on the inside (inner peripheral surface) of each of the first and second bellows does not change. This can suppress the occurrence of buckling in the bellows and improve the stability of the pumping operation. The sealed space may be in a vacuum state or filled with a gas.

Since the inner sealed space of each of the bellows is in the vacuum state, the pressure acting on the bellows is only an external pressure. This can improve the stability of the expanding/contracting operation of the bellows. Otherwise, the pressure applied by the gas filling the inner sealed space of each of the bellows allows a reduction in the peak value of the pressure acting on the bellows. This can enhance the design flexibility of high-pressure design which increases a pump discharge pressure.

Preferably, the liquid supply system further includes an internally evacuated outer vessel. Preferably, the vessel is placed in the outer vessel so as to be surrounded by a vacuum space and the shaft is inserted into the vessel so as to extend from outside the outer vessel and reach the inside of the vessel.

This limits a heat transfer path into the vessel to heat radiation from a wall surface of the outer vessel, the first and second paths, the vessel supporting member, and the like and can enhance a heat insulating effect. Such a reduction in heat in-leak into the liquid to be transmitted can increase a cooling efficiency.

The liquid supply system further includes a third bellows disposed in series to the second bellows in the expanding/contracting direction and having one end portion fixed to the vessel such that the inside of the third bellows is open to the outside of the vessel and also having the other end portion coupled to the second end portion of the second bellows. The third bellows expands/contracts in conjunction with the expansion/contraction of the second bellows. Preferably, the shaft is inserted through the inside of the third bellows and coupled to the second end portion.

This allows the shaft to be coupled to the second end portion of each of the bellows without forming a sliding portion between the shaft and the vessel and allows each of the bellows to expand/contract. Accordingly, it is possible to provide a configuration free from heat generation resulting from the sliding friction of the shaft.

Preferably, the third bellows has an outer diameter smaller than an inner diameter of the second bellows and is disposed so that at least a part thereof is located inside the second bellows.

This can achieve a reduction in the size of the vessel in the expanding/contracting direction of the bellows.

Advantageous Effects of the Disclosure

The present disclosure can achieve an improvement in pumping function.

DRAWINGS

FIG. 1 is a schematic diagram showing a configuration of the liquid supply system according to an example of the present disclosure;

FIGS. 2(*a*) to 2(*c*) are schematic diagrams illustrating an operation of the liquid supply system according to the example of the present disclosure;

Figure 5:
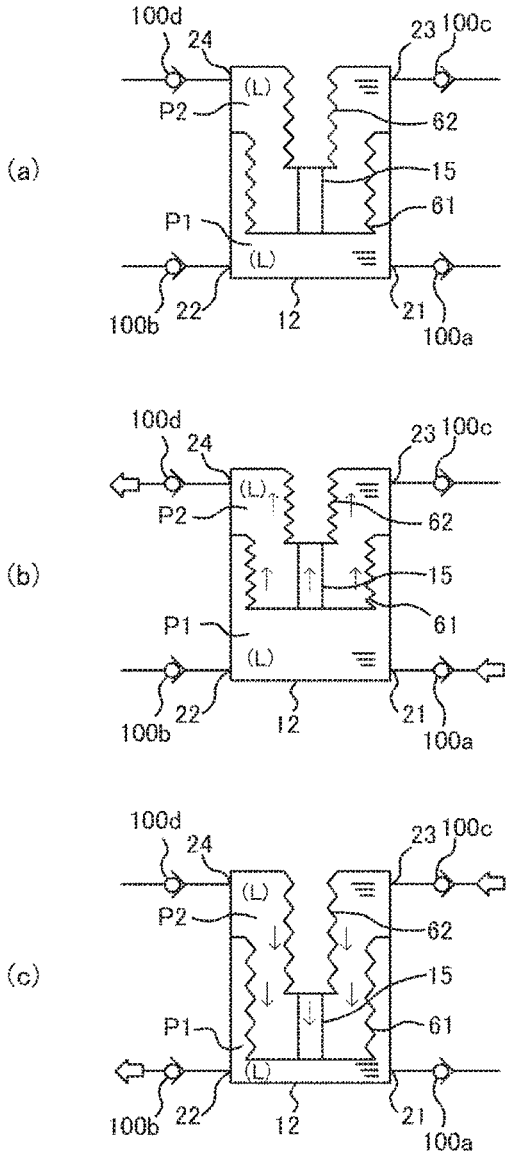
Figure 6:
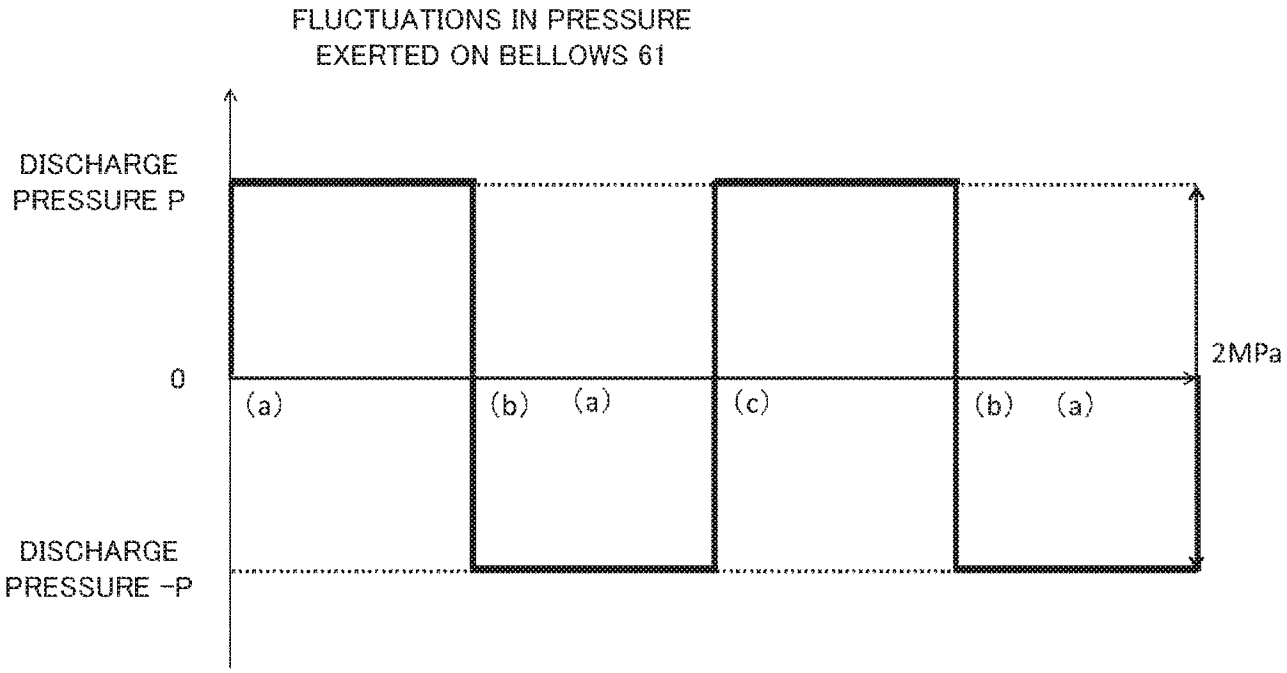

FIGS. 5(*a*) to 5(*c*) are schematic diagrams illustrating an operation of a liquid supply system according to a conventional example; and FIG. 6 is a view showing fluctuations in the discharge pressure of the liquid supply system according to the conventional example.

DETAILED DESCRIPTION

Referring now to the drawings, embodiments for carrying out the present disclosure will be illustratively described below in detail on the basis of examples. However, the dimensions, materials, shapes, relative arrangement, and the like of the components described in these examples are not intended to limit the scope of the disclosure only thereto unless particularly described otherwise.

Example 1

Figure 1:
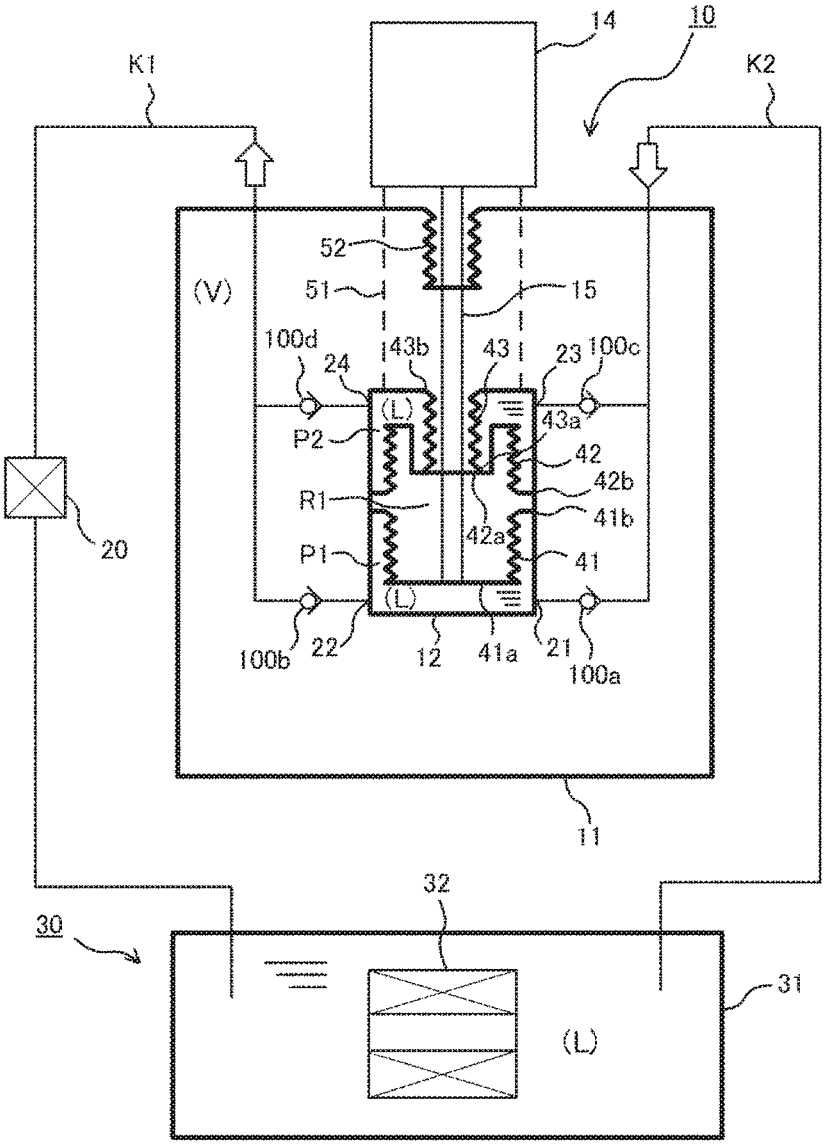

Referring to FIG. 1, a description will be given of a liquid supply system according to an example of the present disclosure. FIG. 1 is a schematic structural view of the liquid supply system according to the example of the present disclosure.

A liquid supply system 10 is a pump apparatus for a low-temperature fluid which constantly supplies an ultracold liquid L into a container 31 made of a resin to cause a to-be-cooled device 30 in which a superconducting cable 32 is provided in the container 31 to maintain the superconducting cable 32 in a superconductive state. Specific examples of the ultracold liquid L include liquid nitrogen and liquid helium.

The liquid supply system 10 generally includes an internally evacuated first vessel (outer vessel) 11 and a second vessel 12 placed in the first vessel 11 so as to be surrounded by a vacuum space. In the second vessel 12, three bellows 41, 42, 43 are generally arranged in series in the respective expanding/contracting directions thereof to partition the inside of the vessel into three sealed spaces. The second vessel 12 is supported in the first vessel 11 by a supporting member 51 inserted into the first vessel 11 from outside the first vessel 11.

The first and second bellows 41 and 42 have the same diameter and are disposed to be arranged in series to each other in the respective expanding/contracting directions, while sharing the same axial center. Respective end portions (first end portions) 41*b* and 42*b* of the first and second bellows 41 and 42 which are close to each other are fixed to the inner wall of the vessel 12. On the other hand, respective end portions (second end portions) 41*a* and 42*a* of the first and second bellows 41 and 42 which are distant from each other are integrated by a shaft 15 fixed thereto, which will be described later, and configured to be movable in the respective expanding/contracting directions.

The third bellows 43 is disposed opposite to the first bellows 41 relative to the second bellows 42 to be arranged in series to the second bellows 42. The third bellows 43 has an outer diameter smaller than the inner diameter of the second bellows 42 and is disposed to have a part thereof located inside the second bellows 42 in the expanding/contracting direction. One end portion 43*b* of the third bellows 43 is fixed to the inner wall of the vessel 12 such that the inside of the third bellows 43 is open to the outside of the vessel 12. The other end portion 43*a* of the third bellows 43 is coupled to the end portion 42*a* of the second bellows 42 so that the third bellows 43 expands/contracts with the expansion/contraction of the second bellows 42.

The end portion 41*a* of the first bellows 41 is closed. The sealed space formed of the inner region of the second vessel 12 which is located outside the first bellows 41 forms a first pump chamber P1. The sealed space formed of the inner region of the second vessel 12 which is located outside the second and third bellows 42 and 43 forms a second pump chamber P2. The space between the end portion 42*a* of the second bellows 42 and the end portion 43*a* of the third bellows 43 is closed, while the space between the end portion 41*b* of the first bellows 41 and the end portion 42*b* of the second bellows 42 is open. In the second vessel 12, the inner region of the first bellows 41 and the inner region the second bellows 42 form one sealed space R1.

In the second vessel 12, a first inlet port 21 which sucks in the liquid L from a return path (return pipe) K2 communicating with the outside of the system into the first pump chamber P1 and a first outlet port 22 which transmits the liquid L that has been sucked in from within the first pump chamber P1 to a supply path (supply pipe) K1 communicating with the outside of the system are provided. Additionally, in the second vessel 12, a second inlet port 23 which sucks in the liquid L from the return path K2 into the second pump chamber P2 and a second outlet port 24 which transmits the liquid L that has been sucked in from within the second pump chamber P2 to the supply path K1 are also provided. In the first and second inlet ports 21 and 23, respective check valves 100*a* and 100*c* are provided while, in the first and second outlet ports 22 and 24 also, respective check valves 100*b* and 100*d* are provided.

The shaft 15 configured to be reciprocally moved by a linear actuator 14 as a drive force extends from outside the first vessel 11 into the sealed space R1 of the second vessel 12 through the inside of the third bellows 43. To the shaft 15, the end portion 41*a* of the first bellows 41 and the end portion 42*a* of the second bellows 42 are fixed. Accordingly, with the reciprocal movement of the shaft 15, each of the bellows expands/contracts.

The shaft 15 is configured to be inserted into the first vessel 11 from outside thereof via a bellows 52 provided in the first vessel 11. The bellows 52 has one end fixed to the first vessel 11 and the other end fixed to the shaft 15 and is configured to expand/contract with the reciprocal movement of the shaft 15.

Figure 2:
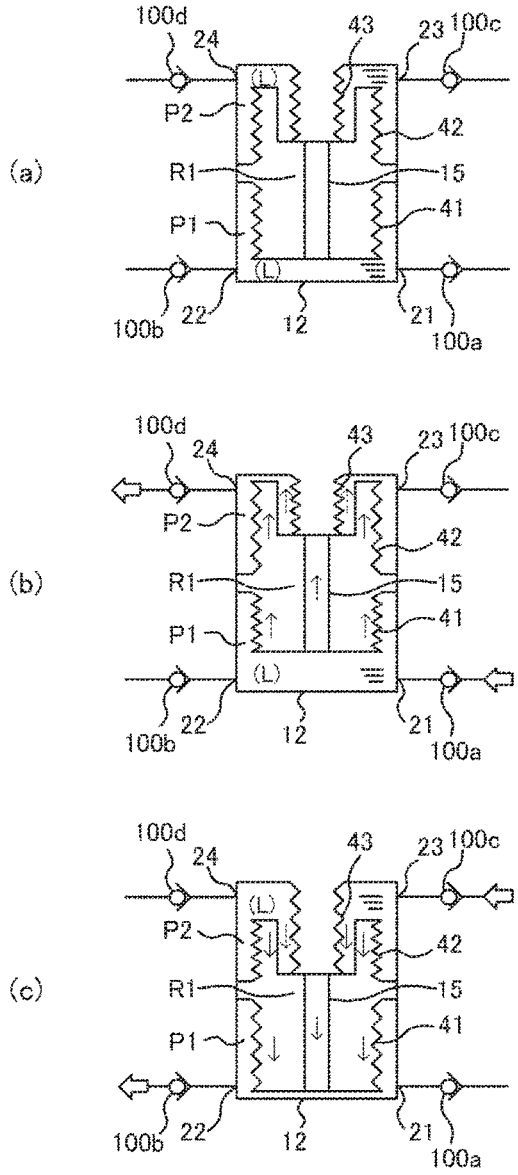

Referring to FIGS. 2(*a*) to 2(*c*), a description will be given of an operation of the liquid supply system 10. FIGS. 2(*a*) to 2(*c*) are schematic diagrams illustrating the operation of the liquid supply system according to the example of the present disclosure. FIG. 2(*a*) is a view showing the inside of the second vessel 12 in a state where the bellows 41 and 42 have been displaced neither in the extending directions nor in the contracting directions. FIG. 2(*b*) is a view showing the inside of the second vessel 12 in a state where the liquid L is sucked from the return path (first path) K2 into the first pump chamber P1, while the liquid L is transmitted from the second pump chamber P2 to the supply path (second path) K1, i.e., in a state where the bellows 41 has maximally contracted and the bellows 42 has maximally expanded. FIG. 2(*c*) is a view showing the inside of the second vessel 12 in a state where the liquid L is sucked from the return path (first path) K2 into the second pump chamber P2, while the liquid L is transmitted from the first pump chamber P1 to the supply path (second path) K1, i.e., in a state where the bellows 41 has maximally expanded and the bellows 42 has maximally contracted.

When the shaft 15 moves so as to contract the first bellows 41 and expand the second bellows 42 (FIG. 2(*a*)→FIG. 2(*b*)), the liquid L is transmitted from within the second pump chamber P2 to the supply path K1 via the second outlet port 24, while the liquid L is sucked into the first pump chamber P1 via the first inlet port 21. On the other hand, when the shaft 15 moves so as to expand the first bellows 41 and contract the second bellows 42 (FIG. 2(*b*)→FIG. 2(*a*)→and FIG. 2(*c*)), the liquid L is sucked into the second pump chamber P2 via the second inlet port 23, while the liquid L is transmitted from within the first pump chamber P1 to the supply path K1 via the first outlet port 22. Thus, in either direction when the shaft 15 reciprocally moves, the liquid L is transmitted to the supply path K1.

Figure 3:
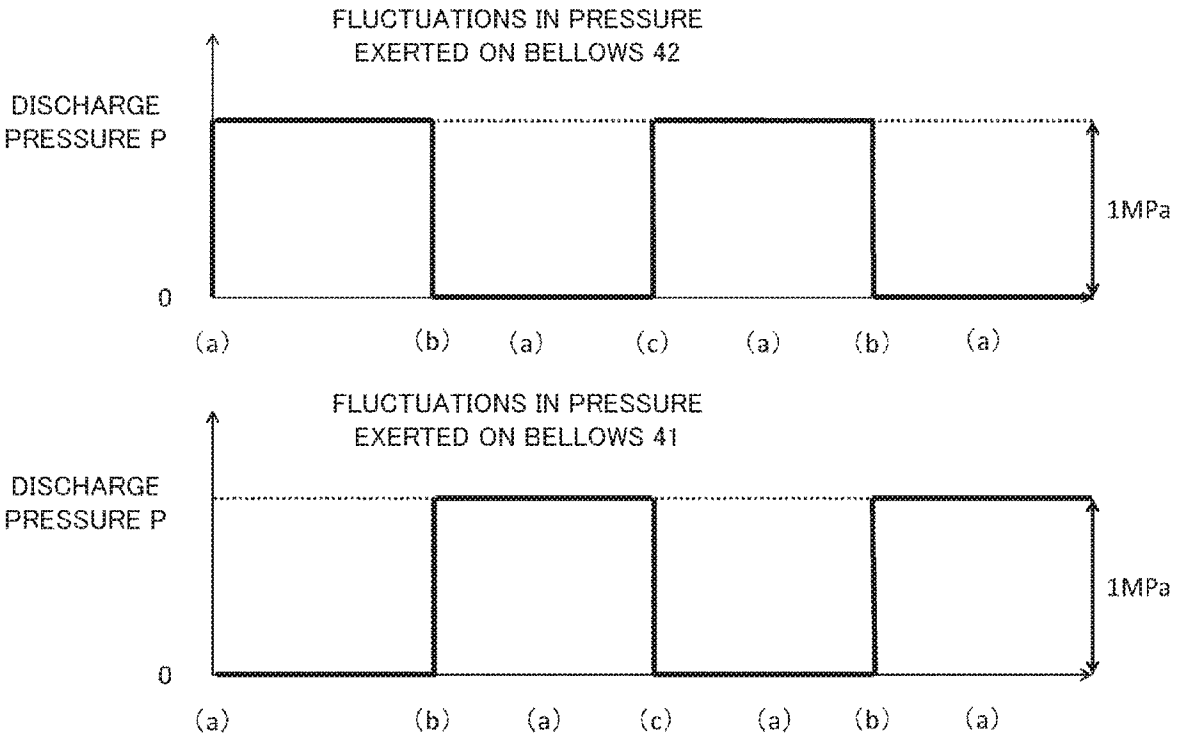
FIG. 3 is a view showing fluctuations in the discharge pressure of the liquid supply system according to Example 1.

The upper part of FIG. 3 is a view schematically showing fluctuations in the pressure exerted on the bellows 42 in the liquid supply system according Example 1. The lower part of FIG. 3 is a view schematically showing fluctuations in the pressure exerted on the bellows 41. In the present example, the sealed space R1 is formed as a vacuum space. Accordingly, the pressure exerted on the bellows 42 in the liquid supply system 10 according to the present example fluctuates with the expansion/contraction of each of the bellows resulting from the reciprocal movement of the shaft 15 so as to alternate between zero and a maximum discharge pressure (discharge pressure P), as shown in FIG. 3. Here, pressure fluctuations when the maximum discharge pressure (discharge pressure P) is 1 MPa are shown. In FIG. 3, (a) corresponds to the position to which the shaft 15 has been displaced in FIG. 2(*a*), (b) corresponds to the position to which the shaft 15 has been displaced in FIG. 2(*b*), and (c) corresponds to the position to which the shaft 15 has been displaced in FIG. 2(*c*). Each of the pressures exerted on the bellows 41 and 42 corresponds to the pressure difference between the pressure outside the bellows and the pressure inside the bellows. In a state where there is no displacement of the shaft 15 prior to the activation of the apparatus, no liquid has been sucked into or discharged from the pump chambers. Accordingly, there is no difference between the pressures outside the bellows 41 and 42 and the pressures inside the bellows 41 and 42 so that the pressure exerted on each of the bellows is 0. With approach to the state (b) (as the liquid is discharged from the first pump chamber P1 and sucked into the second pump chamber P2), the pressure exerted on the bellows 42 increases. When the pressure outside the bellows reaches the maximum discharge pressure (discharge pressure P), the pressure exerted on the bellows 42 becomes maximum (discharge pressure P). With approach to the state (c) (as the liquid is sucked into the first pump chamber P1 and discharged from the second pump chamber P2), the pressure exerted on the bellows 42 decreases and a suction pressure is 0. Accordingly, the pressure exerted on the bellows 42 becomes 0. Note that the pressure fluctuations in the bellows 41 also show the same behavior, but in a different phase.

Thus, in the liquid supply system 10, by the repetition of the reciprocal movement of the shaft 15 and the expanding/contracting operation of each of the bellows, the liquid L is supplied to the to-be-cooled device 30 through the supply path K1. The liquid supply system 10 is configured such that the liquid L equal in amount to the liquid L supplied to the to-be-cooled device 30 through the return path K2 connecting the liquid supply system 10 and the to-be-cooled device 30 is returned to the liquid supply system 10. At a middle point in the supply path K1, a cooler 20 which cools the liquid L to an ultracold state is provided. Due to such a configuration, the liquid L cooled to an extremely low temperature by the cooler 20 circulates between the liquid supply system 10 and the to-be-cooled device 30.

As has been described above, since the liquid supply system 10 has the two pump chambers and supplies the liquid alternately from the two pump chambers, either when each of the bellows contracts or when the bellows expands, the liquid L is transmitted to the supply path K1. This allows the amount of the liquid supplied by the expanding/contracting operation of each of the bellows to be increased to double the amount of the liquid supplied when, e.g., the pumping function is achieved only with the first pump chamber P1. Accordingly, the amount of the liquid L supplied by one expanding/contracting operation can be reduced to about one half of the amount of the liquid L supplied when the pumping function is achieved only with the first pump chamber P1 to supply a desired amount of the liquid L. This can reduce the maximum pressure of the liquid in the supply path K1 to about one half. Therefore, it is possible to suppress the adverse effect of fluctuations in the pressure (pulsation) of the supplied liquid.

In addition, the capacities of the sealed spaces R1 formed inside the first and second bellows 41 and 42 do not change even when the first and second bellows 41 and 42 expand/contract. Also, the internal pressures of the sealed spaces R1 acting on the first and second bellows 41 and 42 (pressures acting on the respective inner peripheral surfaces thereof) do not change. That is, the liquid supply system 10 according to the present example has a configuration in which the pump chambers are disposed outside the individual bellows and buckling due to fluctuations in the internal pressures of the bellows does not occur. This eliminates the need to consider buckling due to the internal pressure in the design of the pressure resistance of each of the bellows and thus enhances the design flexibility thereof to be able to achieve a higher discharge pressure. Referring to FIGS. 5(*a*) to 5(*c*) and 6, a description will be given of the advantages of the present example in comparison with a conventional example.

FIGS. 5(*a*) to 5(*c*) are schematic diagrams each illustrating an operation of a liquid supply system according to the conventional example. As shown in FIGS. 5(*a*) to 5(*c*), the liquid supply system according to the conventional example has a configuration in which the two pump chambers P1 and P2 are formed inside and outside a bellows 61. That is, when the bellows 61 and bellows 62 are contracted by the movement of the shaft 15 (FIGS. 2(*a*)→2(*b*)), the liquid L is transmitted from within the second pump chamber P2 to the supply path K1 via the second outlet port 24, while the liquid L is sucked into the first pump chamber P1 via the first inlet port 21. On the other hand, when the bellows 61 and 62 are expanded by the movement of the shaft 15 (FIG. 2(*b*)→FIG. 2(*a*)→FIG. 2(*c*)), the liquid L is sucked into the second pump chamber P2 via the second inlet port 23, while the liquid L is transmitted from within the first pump chamber P1 to the supply path K1 via the first outlet port 22.

FIG. 6 is a view showing fluctuations in the discharge pressure of the liquid supply system according to the conventional example. Note that, in the drawing, the pressure exerted on the bellows 61 in an outward direction is assumed to be positive and the pressure exerted on the bellows 61 in an inward direction is assumed to be negative. As shown in FIG. 6, in the configuration of the conventional example, when the liquid L is discharged alternately from the first and second pump chambers P1 and P2, the discharge pressure (discharge pressure P) of the same magnitude alternately acts on the inner and outer sides of the bellows 61. In short, the discharge pressure (discharge pressure P) acts on the bellows in the inward direction and in the outward direction. When a configuration for obtaining the same maximum discharge pressure (1 MPa) as obtained in the present example is assumed, pressure fluctuations therein are double the pressure fluctuations in the configuration of the present example (FIGS. 3 and 6). Accordingly, the pressure resistance performance required of the bellows 61 is also double the pressure resistance performance required of the bellows in the present example. In addition, since the conventional example is configured such that the internal pressure acts on the bellows 61, when the discharge pressure is to be increased, the internal pressure acting on the bellows 61 is also increased. As a result, buckling is likely to occur in the bellows 61. In general, a bellows is tolerant to an external pressure but weak to an internal pressure. When a high internal pressure acts on the bellows, buckling is likely to occur therein.

Thus, according to the present example, the pressure acting on each of the bellows is only the external pressure. This can increase the pump discharge pressure and also improve the stability of the expanding/contracting operation of the bellows compared to those in the configuration of the conventional example in which the internal pressure acts on the bellows. Accordingly, it is possible to reduce the number of circulators placed for the cable. Moreover, since the liquid can be supplied even when the topography has a level difference, the degree of freedom in laying a cable improves.

In addition, the present example uses a structure in which the periphery of the second vessel 12 is surrounded by the vacuum space in the first vessel 11. As a result, the vacuum space surrounding the second vessel 12 achieves the function of preventing heat transfer to be able to inhibit heat generated in the linear actuator 14 or atmospheric heat from being transferred to the liquid L. That is, heat exchange with the liquid L is limited to heat radiation from the wall surface of the first vessel 11 as a vacuum insulated vessel and heat transfer via the supporting member 51 of the second vessel 12 or each of the paths. Consequently, heat in-leak into the liquid L can be reduced. Even if heat is transferred to the liquid L to cause the vaporization thereof, the new liquid L is constantly supplied. This also produces a cooling effect and can thus inhibit the liquid L from being heated to a temperature at which the liquid L is vaporized in the pump chambers. Accordingly, there is no degradation of the pumping function.

In the present example, the shaft 15 is inserted into the second vessel 12 via the end portion 43*a* of the third bellows 43 which is opposite to the end portion 43*b* thereof fixed to the second vessel 12 and coupled to each of the bellows, and the third bellows 43 is configured to expand/contract with the reciprocal movement of the shaft 15. As a result, each of the pump chambers P1 and P2 and the sealed space R1 is formed without forming a sliding portion between the shaft 15 and the second vessel 12. Accordingly, there is no generation of heat due to frictional resistance resulting from sliding.

Also, in the present example, the third bellows 43 has the outer diameter smaller than the inner diameter of the second bellows 42 and is disposed to have at least a part thereof located inside the second bellows 42. Since even the part of the third bellows 43 which is located inside the second bellows 42 can be used as a pump space, there is no need to enlarge the space and accordingly the size of the second vessel 12 can be reduced.

In the present example, the sealed space R1 is formed as the vacuum space. Therefore, the sealed space R1 may also be configured to communicate with the vacuum space around the second vessel 12.

Example 2

In contrast to Example 1 described above in which the sealed space R1 is formed as the vacuum space, Example 2 of the present disclosure uses a configuration in which the sealed space R1 is filled with a gas. The components are otherwise the same as in Example 1 so that the same components are designated by the same reference numerals and a description thereof is omitted.

As the gas sealed in the sealed space R1, a gas which is immune to such a state change as liquefaction or freezing in an environment in which the present system is used is used.

Examples of the gas include neon gas, helium gas, and the like. The pressure of the gas sealed in the sealed space R1 is set to a value in a range (preferably ½ of the discharge pressure) from a vacuum pressure (−100 kPa) to a desired discharge pressure.

Figure 4:
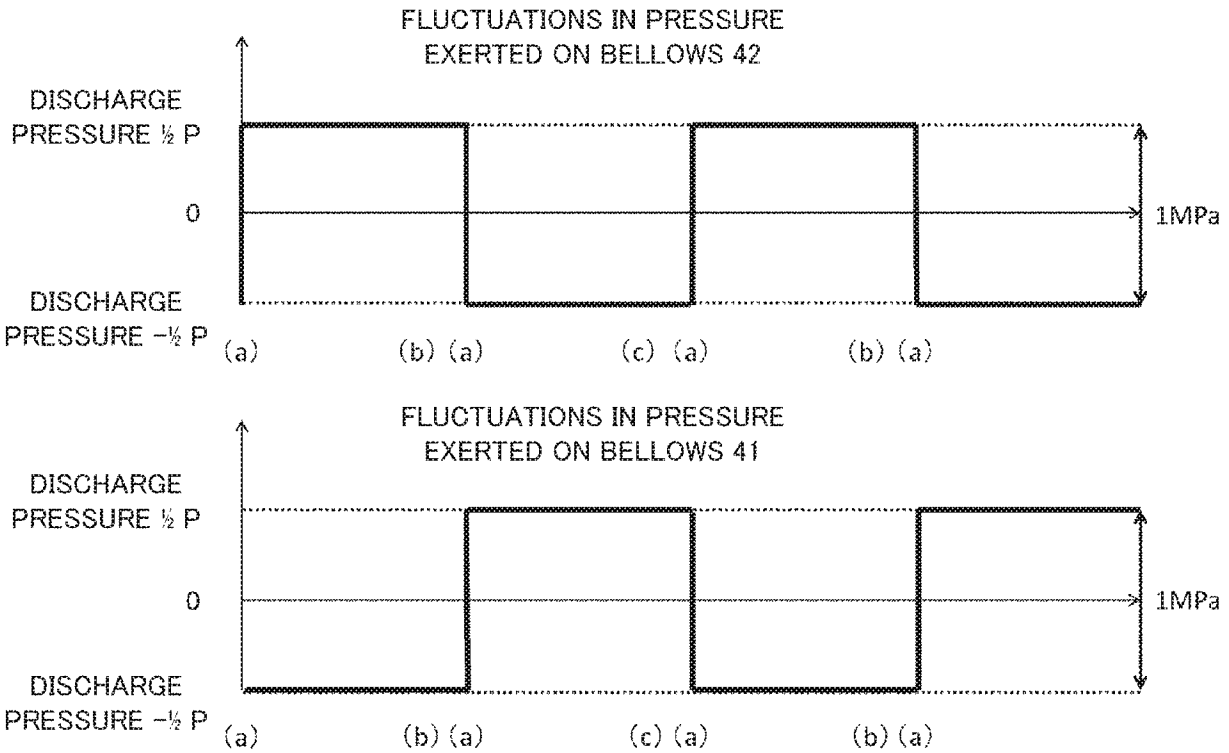
FIG. 4 is a view showing fluctuations in the discharge pressure of a liquid supply system according to Example 2.

FIG. 4 is a view schematically showing fluctuations in the discharge pressure of a liquid supply system according to Example 2, of which the upper part shows fluctuations in the pressure exerted on the bellows 42 and the lower part shows fluctuations in the pressure exerted on the bellows 41. FIG. 4 shows fluctuations in discharge pressure when a gas under a pressure equivalent to ½ of the discharge pressure (discharge pressure P) is sealed in the sealed space R1. The fluctuation range of the discharge pressure is 1 MPa, which is the same as in Example 1 described above. However, the peak value thereof is ½ of that in Example 1. The pressure exerted on the bellows corresponds to the pressure difference between the internal pressure of the sealed space R1 and the pressure in each of the pump chambers P1 and P2. Accordingly, when the gas under the pressure equivalent to ½ of the discharge pressure is sealed in the sealed space R1, since the maximum pressure in the pump chamber is the discharge pressure P, the pressure exerted on the bellows is given by Discharge Pressure P−(½) Discharge Pressure P and is therefore (½) Discharge Pressure P. The pressure in the sealed space R1 is not limited to the (½) discharge pressure P, but can appropriately be set in accordance with specifications such as the sizes of the two bellows and the size relationship between the two pump chambers. By thus internally pressurizing the bellows 41 and 42 using the sealed gas, the peak value of the pressure acting on each of the bellows 41 and 42 can be reduced. Therefore, it is possible to enhance the design flexibility of high-pressure design which increases the discharge pressure of a pump.

REFERENCE SIGNS LIST

10 Liquid supply system
11 First vessel
12 Second vessel
21 First inlet port
22 First outlet port
23 Second inlet port
24 Second outlet port
14 Linear actuator
15 Shaft
41 First bellows
42 Second bellows
43 Third bellows
51 Supporting member
52 Bellows
20 Cooler
30 To-be-cooled device
31 Container
32 Superconducting cable
K1 Supply path
K2 Return path
L Liquid
P1 First pump chamber
P2 Second pump chamber
R1 Sealed space

The invention claimed is:

1. A liquid supply system, comprising:

a vessel configured to suck in a liquid from a first path communicating with an outside of the system and transmit the liquid that has been sucked in to a second path communicating with the outside of the system;

first and second bellows arranged in series in an expanding/contracting direction thereof in the vessel and having first end portions respectively, which are relatively close to each other and fixed to an inner wall of the vessel, and also having second end portions respectively, which are relatively distant from each other and movable in the expanding/contracting direction; and a shaft which is inserted into the vessel and to which the respective second end portions of the first and second bellows are fixed, the shaft being reciprocally moved in the expanding/contracting direction by a drive source to expand/contract the first and second bellows, wherein a first inner space of the vessel located outside the first bellows defines a first pump chamber provided with a first inlet port through which the liquid is sucked from the first path into the first pump chamber and a first outlet port through which the liquid that has been sucked in is transmitted from within the first pump chamber to the second path, a second inner space of the vessel located outside the second bellows defines a second pump chamber provided with a second inlet port through which the liquid is sucked from the first path into the second pump chamber and a second outlet port through which the liquid that has been sucked in is transmitted from within the second pump chamber to the second path, and a shared sealed space is formed inside each of the first and second bellows, wherein the internal pressures of the shared sealed space acting on the first and second bellows do not change even when the first and second bellows expand and contract.

2. The liquid supply system according to claim 1, wherein the sealed space is in a vacuum state in which the pressure acting on the first and second bellows is only an external pressure.

3. The liquid supply system according to claim 1, wherein the sealed space is filled with a gas.

4. The liquid supply system according to claim 1, further comprising:

an internally evacuated outer vessel, wherein the vessel is placed in the outer vessel so as to be surrounded by a vacuum space, and the shaft is inserted into the vessel so as to extend from outside the outer vessel and reach the inside of the vessel.

5. The liquid supply system according to claim 1, further comprising:

a third bellows disposed in series to the second bellows in the expanding/contracting direction and having one end portion fixed to the vessel such that an inside of the third bellows is open to the outside of the vessel and also having the other end portion coupled to the second end portion of the second bellows, wherein the third bellows expands/contracts in conjunction with the expansion/contraction of the second bellows, and the shaft is inserted through the inside of the third bellows and coupled to the respective second end portions of the first and second bellows.

6. The liquid supply system according to claim 5, wherein the third bellows has an outer diameter smaller than an inner diameter of the second bellows and is disposed so that at least a part thereof is located inside the second bellows.

7. The liquid supply system according to claim 2, further comprising:

an internally evacuated outer vessel, wherein the vessel is placed in the outer vessel so as to be surrounded by a vacuum space, and the shaft is inserted into the vessel so as to extend from outside the outer vessel and reach the inside of the vessel.

8. The liquid supply system according to claim 3, further comprising:

an internally evacuated outer vessel, wherein the vessel is placed in the outer vessel so as to be surrounded by a vacuum space, and the shaft is inserted into the vessel so as to extend from outside the outer vessel and reach the inside of the vessel.

9. The liquid supply system according to claim 2, further comprising:

a third bellows disposed in series to the second bellows in the expanding/contracting direction and having one end portion fixed to the vessel such that an inside of the third bellows is open to the outside of the vessel and also having the other end portion coupled to the second end portion of the second bellows, wherein the third bellows expands/contracts in conjunction with the expansion/contraction of the second bellows, and the shaft is inserted through the inside of the third bellows and coupled to the respective second end portions of the first and second bellows.

10. The liquid supply system according to claim 3, further comprising:

a third bellows disposed in series to the second bellows in the expanding/contracting direction and having one end portion fixed to the vessel such that an inside of the third bellows is open to the outside of the vessel and also having the other end portion coupled to the second end portion of the second bellows, wherein the third bellows expands/contracts in conjunction with the expansion/contraction of the second bellows, and the shaft is inserted through the inside of the third bellows and coupled to the respective second end portions of the first and second bellows.

11. The liquid supply system according to claim 4, further comprising:

a third bellows disposed in series to the second bellows in the expanding/contracting direction and having one end portion fixed to the vessel such that an inside of the third bellows is open to the outside of the vessel and also having the other end portion coupled to the second end portion of the second bellows, wherein the third bellows expands/contracts in conjunction with the expansion/contraction of the second bellows, and the shaft is inserted through the inside of the third bellows and coupled to the respective second end portions of the first and second bellows.

* * * * *